United States Patent [19]

Morris

[11] Patent Number: 4,715,090

[45] Date of Patent: Dec. 29, 1987

[54] DEMOUNTABLE HINGES

[75] Inventor: Barry S. Morris, Walsall, England

[73] Assignee: The Bloxwich Lock and Stamping Company Limited, Walsall, England

[21] Appl. No.: 910,647

[22] Filed: Sep. 23, 1986

[30] Foreign Application Priority Data

Dec. 18, 1985 [GB] United Kingdom ..... 8531168
Jul. 28, 1986 [GB] United Kingdom ..... 8618369

[51] Int. Cl.[4] ..... E05D 5/12

[52] U.S. Cl. ..... 16/261; 16/381; 16/263; 16/264

[58] Field of Search ..... 16/261, 262, 273, 380, 16/381, 386, 263, 264, 270, 374; 403/154, 324, 378, 379

[56] References Cited

U.S. PATENT DOCUMENTS 2,937,399 10/1957 DeVore ..... 16/263
4,372,703 2/1983 Szostak ..... 403/378

FOREIGN PATENT DOCUMENTS 467780 10/1952 Italy ..... 16/263
2147655 5/1985 United Kingdom .

*Primary Examiner*—Nicholas P. Godici
*Assistant Examiner*—Edward Brown
*Attorney, Agent, or Firm*—Louis Bernat

[57] ABSTRACT

A demountable hinge has a hinge pin held captive to a first hinge knuckle by a circlip and releasably held to a second hinge knuckle by a retaining screw threadedly engaged with the second knuckle and having a frusto-conical locking surface which makes a locking engagement with a frusto-conical surface on the hinge pin when the retaining screw is tightened. The engagement between the two frusto-conical surfaces urges the hinge pin axially of the second leaf to provide a firm engagement between a further frusto-conical surface on the pin and a complementary surface on the second knuckle. The hinge knuckles can be separated, for demounting a vehicle door, after partially unscrewing the retaining screw. In one construction in order to reduce the amount by which a door needs to be lifted for demounting, the second knuckle has a cut-out to permit the hinge pin to be disengaged from that knuckle after a reduced axial displacement of the knuckles.

6 Claims, 18 Drawing Figures

DEMOUNTABLE HINGES

This invention relates to a demountable hinge primarily, but not exclusively, for a vehicle door.

Demountable hinges are now becoming popular with vehicle manufacturers because they enable the car body with the doors fitted to be painted and then the doors to be removed to provide improved access to the interior of the car body for the installation of other components.

Demountable hinges need to provide accurate realignment of the door when the door is subsequently remounted, and yet the cost of the hinge should, ideally, be little more than that of a conventional hinge.

A demountable hinge has been proposed in G.B.-A-2 147 655A in which the hinge pin is releasably locked in one hinge knuckle by a plain transverse pin engaging in an arcuate cut-out in a plain cylindrical portion of the hinge pin.

There are various disadvantages with that arrangement. Firstly, since the cylindrical portion of the hinge pin has to be dimensioned to permit its removal there is likely to be some undesirable play between the pin and its mating hinge knuckle. Secondly, the use of an arcuate cut-out in the hinge pin would require the hinge pin to be angularly positioned prior to insertion of the transverse pin. Finally, the transverse pin would need to be completely removed to enable demounting of the door.

According to this invention a demountable hinge comprises first and second hinge knuckles, a hinge pin journalled in the first knuckle, means holding captive the hinge pin to the first knuckle against axial displacement relative thereto, a part of the hinge pin which projects from the first knuckle being adapted to be received within the eye of the second knuckle, said part comprising a portion of substantially frusto-conical shape with the smaller diameter end of the frusto-conical portion being towards the first knuckle, and a threaded locking member adapted to be received in a transverse bore in the second knuckle which breaks into the eye, the threaded locking member having a substantially frusto-conical locking surface, and the arrangement being such that when the hinge pin part is within the eye of the second knuckle the locking member can be threadedly tightened such that a locking engagement is provided between the frusto-conical locking surface of the locking member and the frusto-conical portion of the hinge pin.

Thus on tightening of the locking member a strong wedging engagement can be produced between the frusto-conical locking surface of the locking member and the frusto-conical surface of said hinge pin portion, and this engagement can be used to releasably clamp the hinge pin to the second knuckle. The hinge pin can be released simply by unscrewing the locking member, which need not be detached.

The locking surface of the locking member is preferably not precisely frusto-conical but is of curved shape to increase the surface area of engagement between the locking member and the pin.

The locking member is preferably in the form of a locking screw having a threaded shank.

The shank may receive a threaded nut which abuts with the outside of the second knuckle, or the shank may be threadedly engageable with a complementarily threaded portion of said bore in the second knuckle. An enlarged head on the screw provides the locking surface and is provided with a formation engageable by a tool to enable the locking screw to be screwed in and out of the bore.

The formation is preferably a shaped recess in the screw head, but it may be an external projection or recess in the head in which case it would be arranged that the head projects from the second knuckle.

It will be appreciated that such a locking screw or nut can easily be unscrewed with an appropriate tool to allow the co-operating frusto-conical surfaces to be disengaged to permit the second knuckle to be removed from the hinge pin, for demounting of a door for example.

The locking member may be held captive by suitable means, such as a spring clip, to the second knuckle, or it may be readily removable.

The hinge pin is preferably provided with an abutment surface which is spaced axially from the frusto-conical locking surface, faces substantially towards the frusto-conical locking surface, and is adapted to engage with a corresponding abutment surface on or in the second knuckle, the arrangement being such that the abutment surfaces are pulled into locking engagement by the co-operation between the frusto-conical locking surface of the locking member and the frusto-conical surface of the hinge pin portion, which tends to pull the second knuckle axially of the hinge pin.

The abutment surfaces are preferably shaped to provide axial alignment of the hinge pin and second knuckle.

Preferably the abutment surface on the hinge pin is a further frusto-conical surface, which opposes the frusto-conical surface of said hinge pin portion to provide a generally hourglass shape to the hinge pin part. The corresponding abutment surface on the second knuckle then provides a funnel-shaped guide for guiding the free end of the hinge pin into axial alignment with the knuckle bore on remounting the door or other hinged item.

A demountable vehicle door hinge in accordance with the invention will now be described, by way of example only, with reference to the accompanying drawings in which.

Figure 1:
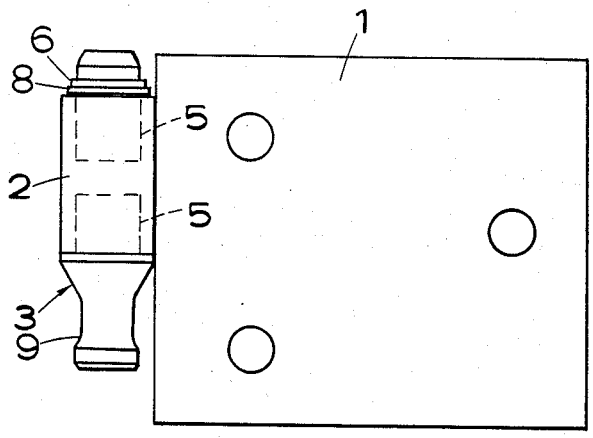
FIG. 1 is a side view of a first hinge leaf and knuckle to which is held captive a hinge pin.
Figure 2:
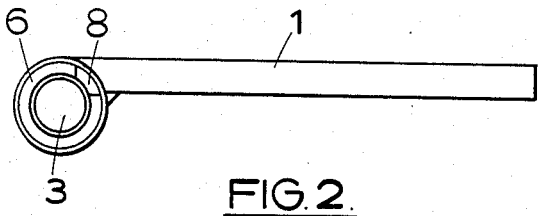
FIG. 2 is a plan view of the first hinge leaf and knuckle.
Figure 3:
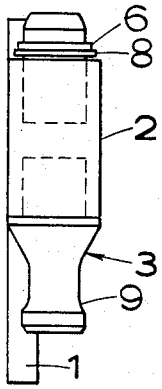
FIG. 3 is a view looking from the right in FIG. 1.
Figure 10:
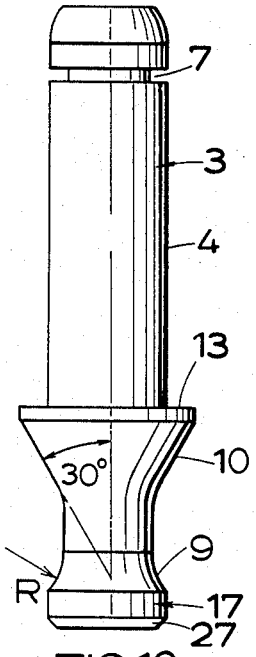
FIG. 10 is an enlarged side view of the hinge pin.

With reference to FIGS. 1 to 3 a first hinge leaf 1, which is shown as a flat leaf but could be of any suitable shape to co-operate with a hinged member, is carried by a first knuckle 2 in which is journalled a hinge pin 3, shown in detail in FIG. 10. The plain shank 4 of the hinge pin 3 is rotatable in a pair of bushes, such as Pampas (Trade Mark) bushes, indicated at 5 which are secured in opposite ends of the bores of the first knuckle 2.

Hinge pin 3 is held captive to the first knuckle 2 by a circlip 6 engaging a recess 7 in the upper end of the pin 3, a washer 8 being arranged between the circlip 6 and the upper end of knuckle 2. Instead of circlip 6 the pin 3 could be held captive to knuckle 2 in other ways, such as by deformation of the end of pin 3, by riveting or by a nut.

Figure 7:
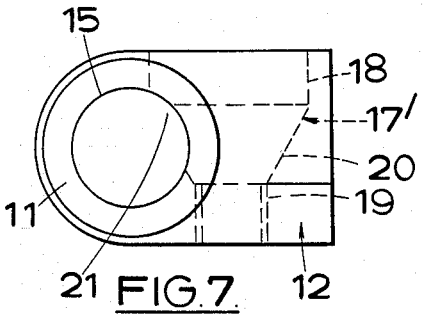
FIGS. 7, 8 and 9 are enlarged views of the second knuckle corresponding respectively to FIGS. 5, 4 and 6.

The lower part of hinge pin 3 comprises a first substantially frusto-conical portion 9 engaged in use by the locking screw, as will be explained, and a second, opposing, frusto-conical portion 10 which constitutes an abutment surface for engagement with a complementarily shaped abutment surface 11 on the second knuckle 12, shown in FIGS. 4 and 7. The pin portion 10 terminates at its upper end in an annular shoulder 13 which bears against the underside of the lower bush 5 to bear the vertical load on the hinge in use.

Figure 4:
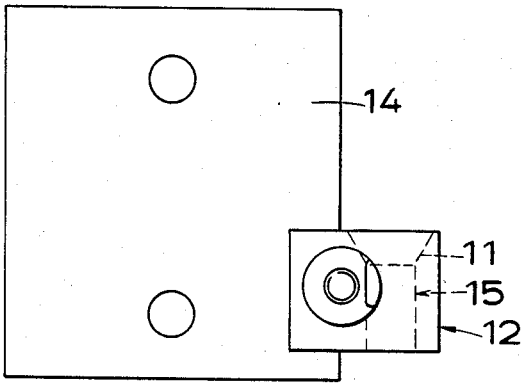
FIG. 4 is a side view of a second hinge leaf and knuckle for attachment to the parts of FIG. 1.
Figure 5:
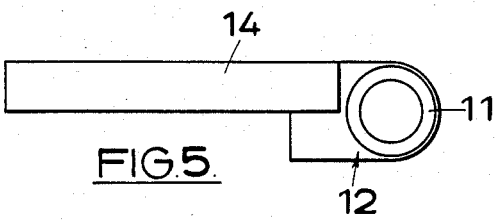
FIG. 5 is a plan view of the second leaf and knuckle of FIG. 4.
Figure 6:
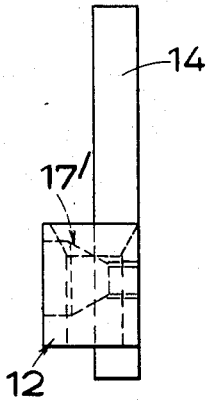
FIG. 6 is a view looking from the right in FIG. 4.

With reference to FIGS. 4 to 6, the second knuckle 12 carries a second hinge leaf 14 which is again for convenience shown as a plain hinge leaf but it could be of any suitable shape.

With the illustrated hinge it is intended that the first leaf 1 be secured to the door pillar, and the second leaf 2 to the door, but if desired the hinge could be inverted and the leaf 1 could instead be secured to the door.

Figure 8:
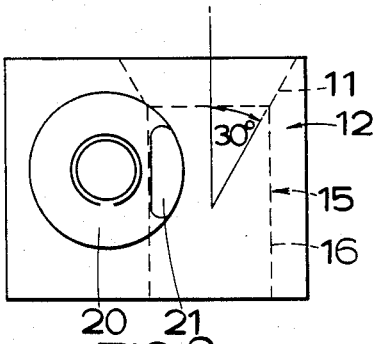
Figure 9:
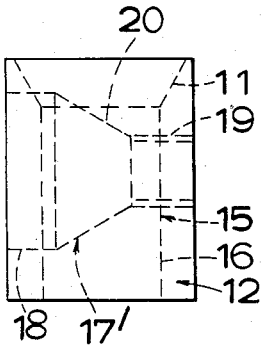

With reference to FIG. 8, the bore 15 of the second knuckle comprises a plain bore portion 16 to which the frusto-conical abutment surface 11 provides a counterbore or entrance funnel for guiding the lower end 17 of the hinge pin 3 into the bore portion 15 on initial assembly of the hinge, and on remounting of the door following demounting. With reference to FIGS. 7 and 9 the second knuckle 12 is provided with a through bore 17' extending transversely to the axis of the bore 15 which receives the hinge pin ad approximately tangential thereto. Bore 17' comprises larger and smaller diameter bore portions 18 and 19 respectively connected by a frusto-conical bore portion 20 which breaks through into the bore portion 15 for the hinge pin, thereby producing a window 21. The smaller diameter bore portion 19 is threaded.

Figure 11:
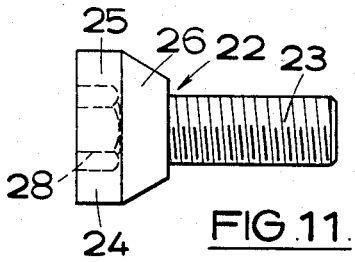
FIG. 11 is an enlarged side view of a locking screw.
Figure 12:
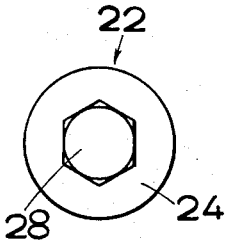
FIG. 12 is an end view of the locking screw looking from the left in FIG. 11.

A locking screw 22, FIGS. 11 and 12, is adapted to fit wholly within the transverse bore 17' releasably to lock the hinge pin 3 in bore 15, and thereby to hold the hinge in an assembled condition. The screw 22 comprises a threaded shank 23 for threaded engagement with the threads of bore portion 19, a head 24 comprising a cylindrical portion 25 adapted to be a rotating fit in bore portion 18, an a frusto-conical portion 26 which provides a frusto-conical locking surface for locking engagement with frusto-conical portion 9 of the hinge pin 3 which projects through window 21, and is received in use substantially within bore portion 20.

With reference to FIG. 10 it will be seen that the cone angle of abutment surface 10 is 60°, as is that of the complementary surface 11, this angle being chosen to avoid a wedging action between those surfaces that would make it difficult to release the pin 3 from the second knuckle 12 for demounting the vehicle door. In general an angle in the range substantially 50° to substantially 65° would be suitable.

Figure 13:
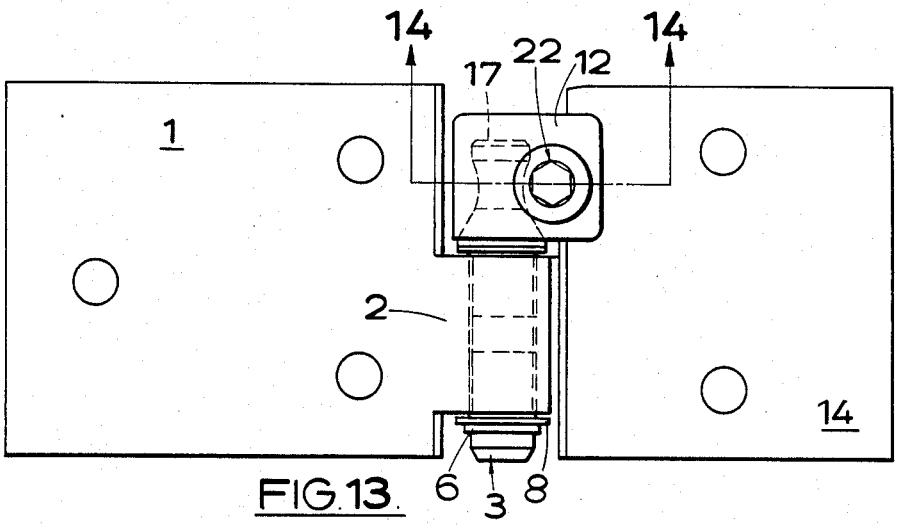
FIG. 13 is a side view of the assembled hinge.
Figure 14:
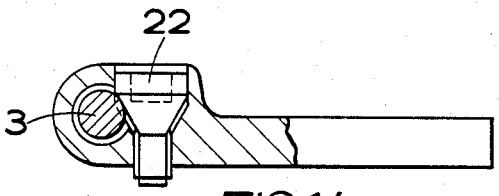
FIG. 14 is a cross-section on the line 14—14 of FIG. 13 showing the co-operation between the securing screw and the hinge pin.

The mounting of the second leaf 14 to the first leaf 1, knuckle 2 and pin 3, assembled as in FIG. 1, to bring the leaves to the assembled condition of FIG. 13, is accomplished by dropping the second knuckle 12 over the upper end 17 of pin 3, this being assisted by the shape of surface 11 and by a small chamfer 27 on the pin 3. The locking screw 22 is then screwed into the transverse bore 17' by means of a key engageable with a hexagon socket 28, or socket of other suitable shape, provided in the screw head 24, the threads of shank 23 co-operating with those of bore portion 19. Alternatively the head 24 could be made longer so that it projects from the bore 17', and the external surface of the head could be provided with projections or recesses for engagement by a suitable tool. This screwing action brings the locking surface 26 into engagement with the surface 9 of the pin, so that on further tightening of the screw 22 the co-operation between surfaces 26 and 9 tends to draw the knuckle 12 downwards on pin 3 and forces abutment surface 10 on the pin more firmly against surface 11, and the pin 3 will be urged transversely in bore portion 16 to lock the pin 3 to the second knuckle 12.

In order to increase the surface of engagement between the surfaces 26 and 9 the surface 9 is not precisely frusto-conical, but is made as a curved surface, the concavity being indicated in FIG. 10 by the radius of curvature R.

In a modification, not shown, the shank 23 of the locking screw 22 is extended, and the extension is adapted to receive a spring clip which holds captive the screw 22 to the second knuckle 12, yet permits sufficient unscrewing of the screw 22 to permit removal of the hinge pin 3.

In a further modification, now shown, the shank 23 is extended to receive a nut and no threads are provided on the bore portion 19, the nut being used to tighten the member 22 to the pin 3.

In yet a further modification, not shown, the locking screw 22 of FIG. 11 is threadedly engageable with a nut, and the bore 17' is made sufficiently large to enable the nut to be axially slidable therein and to abut with the pin 3.

Preferably the nut is provided with a frusto-conical locking surface similar to surface 26 so that the surface 9 of the pin is engaged both by the frusto-conical locking surface on the screw 22 and by that on the nut. In this case the bore 17' and the external surface of the nut or of the screw head 25 would be complementarily shaped to hold the nut or the screw respectively against rotation relative to the second knuckle 12. For example, the bore 17' could be of hexagonal cross-section.

Figure 16:
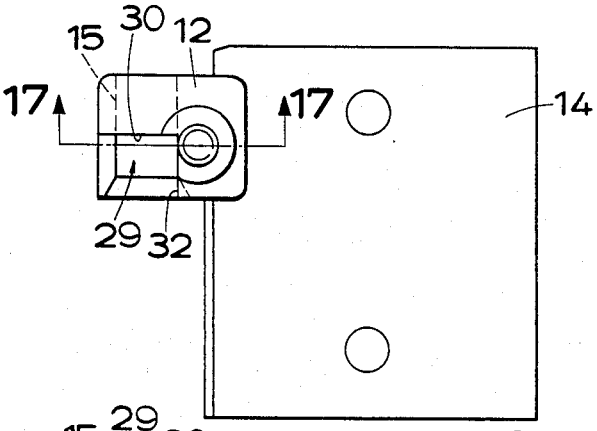
FIG. 16 is a view similar to FIG. 4 but of a second leaf having a modified knuckle.
Figure 18:
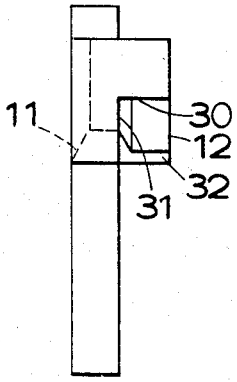
FIG. 18 is a view looking from the left in FIG. 15.
Figure 17:
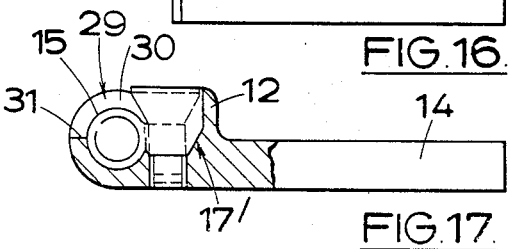
FIG. 17 is a cross-section on the line 17—17 of FIG. 16.

With some cars lifting of a front door to demount the door is severely restricted by the shape of the car wing. In order to reduce the amount by which it is necessary to lift the door to disengage the second knuckle from the hinge pin of the upper hinge of the front door, the second knuckle of the upper hinge is provided in its side with a cut-out which breaks into the hinge pin bore of the second knuckle. FIGS. 16 to 18 show such a modified second knuckle for use in the hinge of FIG. 13, the knuckle 12 having been cut-away on one side for the depth D. The cut-out 29 is defined between a surface 30 which is transverse to the axis of bore 15, a surface 31 which includes the axis of bore 15 and is co-planar with one surface of leaf 14, and a surface 32 which extends parallel to the exis of bore 15 and normal to the plane of the leaf 14.

In order to remove a door which is mounted on a pair of hinges of the type shown in FIG. 13, but in which the upper hinge is modified as in FIGS. 16 to 18, it is necessary to release the locking screws 22 of both hinges, and lift the door sufficiently for the hinge pins of the upper hinge to pass beneath the surface 30, so that the leaves of the upper hinge can be disconnected by tilting of the upper part of the door outwards from the door pillar, this tilting being accommodated by the shape of the hinge pin, FIG. 10, of the lower hinge.

Whilst the cut-out 29 permits disconnection of the leaves without substantial relative axial movement of the leaves of the upper hinge, the presence of the cut-out 29 affects very little the clamping action of the screw 22 on the hinge pin because the cut-out is positioned such that the screw 22 is holding the hinge pin against surface of the knuckle 12 that have not been disturbed in generating the cut-out.

Depending upon which way round the hinges are mounted it may in some cases be necessary to lower a door in order to detach it, and in some cars the use of a cut-out knuckle may then be required on the lower hinge to prevent the bottom of the door fouling the body work, before the leaves of the lower leaf have been disconnected.

Figure 15:
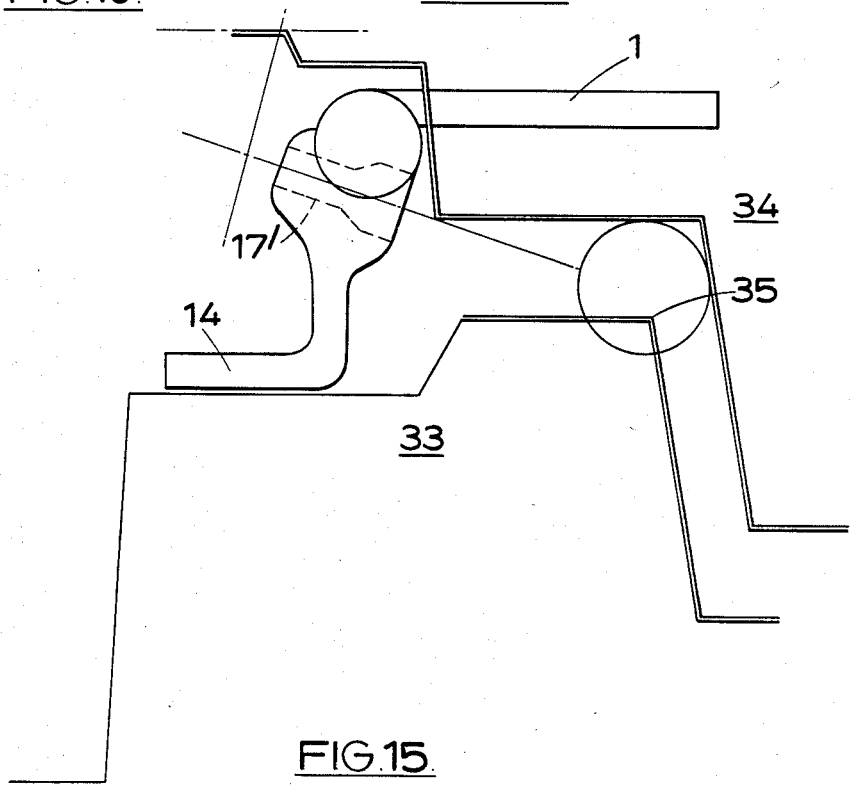
FIG. 15 is a horizontal section through a car door and pillar showing in plan a modified hinge in accordance with the invention.

FIG. 15 shows a modification of the hinge of FIGS. 1 to 12 in which the leaf 14 is cranked for securing to a door pillar 33, the leaf 1 being secured within door 34. The direction of the transverse bore 17' in leaf 2 is chosen to permit a tool to clear pillar corner 35 when the door is opened.

The hinges described are capable of withstanding the current standard strength tests, yet enable rapid demounting of a vehicle door, and quick remounting of the door whilst preserving the axial alignment of the hinge pin 3 and knuckle 12 in the assembled hinge.

I claim:

1. A demountable hinge comprising first and second knuckles, a hinge pin journalled in said first knuckle, said second knuckle having an eye and a transverse bore which breaks into said eye, means holding captive said hinge pin to said first knuckle against axial displacement relative thereto, a part of said hinge pin which projects from said first knuckle being dimensioned to be received within said eye of said second knuckle, and a threaded locking member dimensioned to be received in said transverse bore in said second knuckle, said part comprising a portion of substantially frusto-conical shape, said portion having a smaller diameter end positioned towards said first knuckle, said threaded locking member having a substantially frusto-conical locking surface, whereby when said hinge pin part is within said eye of said second knuckle said locking member can be threadedly tightened such that a locking engagement is provided between said frusto-conical locking surface of said locking member and said frusto-conical portion of said hinge pin.

2. A hinge as in claim 1 wherein said substantially frusto-conical portion of said part is of a curved shape.

3. A hinge as in claim 1 wherein said locking member is in the form of a locking screw having a threaded shank.

4. A hinge as claimed in claim 1 wherein said hinge pin is formed with a first abutment surface which is spaced axially from said frusto-conical locking surface and faces substantially towards said frusto-conical locking surface, said second knuckle is formed with a second abutment surface for engagement with said first abutment surface, said first and second abutment surfaces being pulled into locking engagement by the co-operation between said frusto-conical locking surface of said locking member and said frusto-conical surface of said hinge pin portion when said locking member is tightened.

5. A hinge as claimed in claim 4 wherein said first abutment surface is a further frusto-conical surface, which opposes said frusto-conical surface of said hinge pin portion whereby said hinge pin part has a generally hourglass shape.

6. A hinge as claimed in claim 1 wherein said second knuckle is provided with a cut-out which extends transversely into said eye of said second knuckle whereby said hinge pin can be disengaged from said second knuckle by passing said hinge pin transversely of said eye through said cut-out, said second knuckle having a first end which is adjacent to said first knuckle, said cut-out extending from said first end of said second knuckle to enable said hinge pin to be released from said second knuckle when said first and second knuckles have been separated axially by less than the axial length of said second knuckle.

* * * * *